United States Patent [19]

DeBrunn et al.

[11] 3,995,646

[45] * Dec. 7, 1976

[54] TOBACCO PROCESSING METHOD

[76] Inventors: Albert W. DeBrunn, 51 Diamond St., San Francisco, Calif. 94114; Gregory R. Feist, 1432 Laguna, Burlingame, Calif. 94010

[ * ] Notice: The portion of the term of this patent subsequent to Apr. 1, 1992, has been disclaimed.

[22] Filed: Jan. 20, 1975

[21] Appl. No.: 542,647

Related U.S. Application Data

[63] Continuation of Ser. No. 448,085, March 4, 1974, Pat. No. 3,874,392.

[52] U.S. Cl. ..... 131/17 R; 131/143

[51] Int. Cl.[2] ..... A24B 15/02

[58] Field of Search ..... 131/2, 17, 140–144, 131/135

[56] References Cited

UNITED STATES PATENTS

| | | | |
|---|---|---|---|
| 273,362 | 3/1883 | Howard | 131/143 |
| 1,016,844 | 2/1912 | Moonelis | 131/143 |
| 3,338,248 | 8/1967 | Pavia | 131/143 |
| 3,369,552 | 2/1968 | Carroll | 131/143 |
| 3,372,703 | 3/1968 | Conard, Jr. | 131/135 X |
| 3,599,645 | 8/1971 | Johnson | 131/143 |
| 3,683,937 | 8/1972 | Fredrickson et al. | 131/143 |
| 3,742,962 | 7/1973 | Brochot | 131/143 |
| 3,874,392 | 4/1975 | De Brunn et al. | 131/143 |

*Primary Examiner*—Robert W. Michell
*Assistant Examiner*—V. Millin
*Attorney, Agent, or Firm*—Townsend and Townsend

[57] ABSTRACT

A method for processing tobacco to remove harmful agents in the tobacco and to restore the tobacco with the harmful agents removed to a condition suitable for use in a cigarette. The method first comprises the steps of placing the tobacco in a heated liquid for a preselected time period and subsequently drying the tobacco to remove harmful agents from the tobacco. The dried tobacco is then rehydrated to restore the tobacco to a condition suitable for use in a cigarette by subjecting the dried tobacco to an atmosphere containing water vapor at a reduced temperature for a preselected period of time.

8 Claims, No Drawings

TOBACCO PROCESSING METHOD

This application is a continuation of our copending application for TOBACCO PROCESSING METHOD, Ser. No. 448,085 filed Mar. 4, 1974 now U.S. Pat. No. 3,874,392.

BACKGROUND OF THE INVENTION

The present invention relates to a method for processing tobacco to remove agents from the tobacco which are believed to be harmful.

In the face of repeated warnings by the American Cancer Society, the American Medical Association and other such organizations, legal requirements that warnings be placed on the outside of the cigarette packages and in all advertisements for cigarettes, and in spite of laws banning the advertising of cigarettes in certain media, cigarette smoking in the United States has not been substantially reduced. In fact, the net effect of the above activity seems to have been to make the smoking public immune from such warnings and advertisements, and cigarette smoking has recently begun to increase. Since the measures taken so far to combat cigarette smoking have been fundamentally unsuccessful, the only feasible alternative appears to be the provision of a cigarette which is safe to smoke and which is not physically addictive and the Federal Trade Commission has recently issued a report urging research toward this end.

Attempts to date to produce such a safe cigarette have been almost totally unsuccessful. One of the methods which has been attempted to reduce somewhat the dangers of cigarette smoking is to freeze dry the tobacco as described in the patent to Abbott et al., U.S. Pat. No. 3,704,716. The primary purpose of this method is to expand the tobacco into a larger volume so that less tobacco is used to make each cigarette rather than actually remove the harmful agents from the tobacco. It has been determined in tests conducted by the National Cancer Institute of the Department of Health, Education and Welfare that tar and nicotine levels of cigarettes are not substantially reduced by freeze drying processes now used. To the best of our knowledge, no other method has been advanced which successfully reduces the harmful agents present or produced in the tobacco used in today's cigarette.

SUMMARY OF THE INVENTION

The present invention provides a method for processing tobacco which removes the agents in the tobacco which are believed to be harmful and still leaves the tobacco in a condition suitable for use in a cigarette. First, the tobacco is placed in a boiling liquid. After the tobacco is removed from the liquid, it is allowed to dry. Second, the dried tobacco is subjected to a defined atmosphere and the temperature of the atmosphere is substantially reduced for a preselected period of time.

The exact mechanism by which the harmful agents are removed from the tobacco in the above noted method is not fully understood at the present time. However, it would appear that the boiling of the tobacco contributes to the removal of the harmful agents from the tobacco, but leaves it in a condition basically unsuitable for use in a cigarette. The tobacco is quite friable at this stage. When the dried tobacco is subjected to the defined atmosphere and the temperature reduced, the dried tobacco is rehydrated to restore it to a condition suitable for normal smoking.

As discussed hereinbelow the tar and nicotine levels of cigarette tobacco, the measures normally used to determine the harmful effects of the tobacco, are reduced dramatically by the processing method of the present invention. Furthermore, other less recognized but equally toxic effects of the cigarette tobacco, such as oxides of nitrogen and carbon monoxide are substantially reduced. The extent of these reductions is set forth hereinbelow and is greater than would be expected from a mere expansion of the tobacco, although that is also achieved. The tobacco procesed by the method of the present invention still has characteristics similar to unprocessed tobacco and provides a highly enjoyable but safe cigarette.

The novel features which are believed to be characteristic of the invention, together with other advantages thereof, will be better understood from the following description wherein a preferred embodiment of the process of the present invention is set forth by way of example. It is to be expressly understood, however, that the embodiment disclosed is for the purpose of illustration and description only and is not intended as a definition of the limits of the invention.

DESCRIPTION OF THE PREFERRED EMBODIMENT

The preferred embodiment is illustrated by way of an example which will be discussed below. This embodiment has been utilized to process cigarette tobacco taken from existing cigarettes. However, the example method can also be applied to tobacco leaves or other stages in existing processes of making cigarette tobacco.

EXAMPLE

The first step in the preferred embodiment is to place the tobacco in boiling tap water (actually an aqueous solution) for 15 minutes. The tobacco is then removed from the boiling water and placed on a screen where it is pressed to remove excess moisture. In this example, the tobacco is pressed on the screen by hand. The next step is to lay the pressed tobacco on a sheet and spread the tobacco out to separate the fibers. The tobacco is dried by allowing it to lie on the sheet from 24–36 hours and is exposed to the sun during the day. The term "drying" is used herein to specifically include passive drying such as in this example or active drying such as the infusion of heated air. The dried tobacco at this stage is quite friable and is unsuitable for making cigarettes since it would be crushed into a powder.

The fourth step is to pack the dried tobacco into a glass jar such as the glass liner used in the interior of a thermos bottle. Prior to inserting the tobacco, the jar contains atmospheric air, and the air is not evacuated from the jar. The jar is sealed after the tobacco is inserted so that air can neither enter or escape. The next step is to place the sealed jar containing the tobacco into a bucket filled with dry ice and adding acetone extending approximately half the way up the bucket. The temperature of the dry ice/acetone bath is approximately −109.6° Farenheit, the sublimation temperature of the dry ice. Presumably the temperature in the interior of the jar is at or near the temperature of the bath. The top of the jar is left out of the bath to insure that none of the bath material enters the jar. The jar is left in the bath for approximately seven hours during which time the bath maintains itself at approximately a constant temperature. After the jar is removed from the bath, it is opened and the tobacco is removed. At this time, the tobacco has approximately the feel and body of the original tobacco prior to processing.

The boiling water remaining after the tobacco is removed thereform is extremely black and contains a high content of impurities which have been removed from the tobacco. These impurities include nicotine, tars, and agents which cause nitrous oxides and carbon monixides when the tobacco is burned, all of which are generally believed to be harmful to the smoker. It is presumed therefore that the substantial reduction in the harmful agents in the tobacco occurs during the boiling. However, the results of this boiling is to leave the tobacco in a condition generally unsuitable for smoking.

Placing the tobacco in a sealed container and reducing the temperature in the container to 100° Farenheit or more below zero brings back the original feel and texture of the tobacco. The exact mechanism of this step is also not known. However, it would appear that the reduction in temperature causes the water vapor in the container to condense on the tobacco which rehydrates the tobacco and restores the texture of the tobacco to near its origial condition.

TEST PROCEDURE AND RESULTS

The cigarette tobacco processed by the above method for use a test tobacco as taken from standard, unfiltered "Pall Mall" cigarettes. After processing, the cigarettes were re-rolled by hand using a "Laredo" brand filter kit and a "Tareyton" brand filter charcoal element to form corresponding 85 mm cigarettes with a 25 mm filter. Twenty cigarettes were so formed. "Pall Mall 100 Filter Cigarettes", each measuring 100 mm in length including a 30 mm filter were used as reference cigarettes. Although the filter elements were different, standard elements were used in all cases so that the results would not be significantly affected. All reference cigarettes and samples were individually analyzed.

The smoking machine employed to test the processed tobacco was constructed to duplicate the type B unit described by Kiefer[1], Touey[2] and Mumpower[3]. A vacuum pump was attached to an eight liter surge tank, which was maintained at a guage pressure of 15 psi during smoking. A line from the surge tank led to a rotometer, than to an adjustable needle valve, to a threeway solenoid valve, and then to a T-connector. One side of the T led to a cigarette filter holder and collection flask, the other to an 8-inch water manometer. The pressure drop across the total cigarette during each puff of the smoking cycle was measured using the manometer.

[1]McConnel, Munford and Touey: 1960, *Tobacco Science* 4, Page 55.
[2]Kiefer, Touey and Mempower: 1961, *Tobacco Science* 4, Page 31.
[3]Bay Area Air Pollution Control District: *Sampling and Analytical Methods for Total Nitrogen Oxides*, method 11-3.

Sampling conditions during smoking were a flow rate of 1050 milliliters per minute through the cigarette, and a 35 milliliter puff of 2 second duration and 1 minute frequency at 75° F and 60% relative humidity. The solenoid valve was actuated at 1-minute intervals. At the end of each two-second puff, the valve was closed, terminating the puff and venting the puffing section of the smoking machine to the atmosphere. Methanol (100 milliliters) was placed in the collection flask. Each cigarette was smoked to a length four millimeters from the filter. After sampling, the flask was sealed and left undisturbed for 15 minutes. Aliquots were then removed for TPM (total particulate matter, called "tar"), and nicotine analyses. A Turner Photofluorometer was used for the TPM analyses.

The excitation wavelength was 365 millimicrons, and fluorescence was measured at 415 millimicrons. Correlation of fluorescence readings with TPM was determined gravimetrically on a series of Pall Mall reference cigarettes. This relationship was found to be linear in the 1-10 milligrams of tar range. TPM values for the submitted cigarettes were obtained from this graph.

chromatography using a Varian 1400 instrument and an —OV 17 column held at 120° C. Quantitation was by direct comparison to nicotine standards prepared in methanol.

The results of the above tests for TPM (tar) and total nicotine are presented in the following table wherein the reference cigarettes are designated as "PM" and processed cigarettes as "L".

Table 1

| | | TPM and Total Nicotine | | | |
|---|---|---|---|---|---|
| Cigarette | Total Wt (gm) | No. of Puffs | ΔP ($H_2O$) | TPM (mg) | Total Nicotine-(mg) |
| PM-1 | 1.2045 | 12 | 1.8 | 3.4 | 0.2 |
| PM-2 | 1.2405 | 13 | 2.0 | 2.2 | 0.7 |
| PM-3 | 1.2190 | 11 | 2.0 | 3.2 | 0.8 |
| L-1 | 0.7932 | 11 | 1.3 | 2.9 | < 0.1 |
| L-2 | 0.9309 | 11 | 1.5 | 0.2 | < 0.1 |
| L-3 | 0.7804 | 12 | 1.3 | 2.0 | = 0.1 |
| L-4 | 0.9078 | 12 | 1.6 | 1.7 | < 0.1 |
| L-5 | 0.8873 | 13 | 1.4 | 0.4 | < 0.1 |
| L-6 | 0.8092 | 12 | 1.5 | 0.7 | < 0.1 |
| L-7 | 0.8660 | 11 | 1.3 | 3.6 | = 0.1 |
| L-8 | 0.8687 | 12 | 2.0 | 1.3 | < 0.1 |

As can be seen, the values of tar and nicotine for the processed cigarettes is substantially less than that of the unprocessed cigarettes. In fact, where a total nicotine is noted as being less than 0.1 this is an indication that the amount of nicotine was not measurable by the instruments available. Assuming that the value of the total nicotine is 0.05 mg when the actual value is unreadable, the following average values for tar and nicotine are obtained:

| Cigarette | Total Wt (gm) | No. of Puffs | ΔP ($H_2O$) | TPM (mg) | Total Nicotine (mg) |
|---|---|---|---|---|---|
| PM | 1.2213 | 12 | 1.9 | 2.9 | 0.6 |
| L | 0.8554 | 12 | 1.5 | 1.6 | 0.06 |

Oxide of Nitrogen (NOX) content was determined using a phenoldisulfonicacid colorimetric procedure. An aliquot of absorbing solution as placed in a 1-liter evacuation flask. The opening of the flask was sealed with a stopper through which was inserted a 10 centimeter length of pyrex tubing. The length of tubing which extended over the top of the stopper was attached to a 6-centimeter length of tygon tubing which ended in a cigarette filter holder. The flask was evacuated using a vacuum pump, and the system sealed with a pinch clamp. A cigarette was placed in the holder, and the pinch clamp was slowly released. Each cigarette was smoked using a slow constant draw until the vacuum in the absorbing flask was depleted. The flask was then sealed and allowed to equilibrate undisturbed for 24 hours. Aliquots of the absorbing solution were then taken for analysis.

The following values for oxides of nitrogen were obtained by way of the above test:

Table II

| Cigarette | Total Wt. (gm) | Oxides of Nitrogen (NOX) Length Smoked (cm) | *Total $NO_2$ (mg) | mg $NO_2$ per cm smoked | **$NO_2$ ppm, vol. | $NO_2$, ppm cm smoked |
|---|---|---|---|---|---|---|
| PM-A | 1.3124 | 9.2 | 1.06 | 0.12 | 565 | 61 |
| PM-B | 1.2036 | 9.2 | 1.30 | 0.14 | 691 | 75 |
| PM-C | 1.1869 | 8.5 | 1.12 | 0.13 | 598 | 70 |
| PM-D | 1.2520 | 7.3 | 0.68 | 0.09 | 359 | 49 |
| L-A | 0.9310 | 6.8 | 0.33 | 0.05 | 177 | 26 |
| L-B | 0.7752 | 8.4 | 0.28 | 0.03 | 146 | 17 |
| L-C | 0.8860 | 6.3 | 0.30 | 0.05 | 157 | 25 |
| L-D | 0.8325 | 6.8 | 0.15 | 0.02 | 80 | 12 |

*Total milligrams as $NO_2$ in the absorbing solution.
**Parts per million by volume as $NO_2$ in air.

Again, the quantity of oxides and nitrogen is substantially reduced in the cigarettes using the processed tobacco, as illustrated in the following table giving average values for the two types of cigarettes:

| Cigarette | Total Wt. (gm) | Length Smoked (cm) | Total $NO_2$ (mg) | mg $NO_2$ per cm smoked | $NO_2$ ppm, vol. | $NO_2$,ppm cm smoked |
|---|---|---|---|---|---|---|
| PM | 1.2387 | 8.6 | 1.04 | 0.12 | 553 | 64 |
| L | 0.8562 | 7.1 | 0.27 | 0.04 | 140 | 20 |

To measure carbon monoxide content, a 1-liter evacuation flask was sealed with a stopper through which was inserted a 10 centimeter length of pyrex tubing. The length of tubing which extended over the top of the stopper was attached to a 6-centimeter length of tygon tubing which ended in a cigarette filter holder. The flask was evacuated using a vacuum pump, and the system sealed with a pinch clamp. A cigarette was placed in the holder, and the pinch clamp was slowly released. Each cigarette was smoked using a slow constant draw to a length 4–8 millimeters from its filter. The cigarette was removed, and air was drawn into the flask until the vacuum was deplete. The flask was sealed and allowed to equilibrate for several minutes. A 10 milliliter aliquot of smoke was withdrawn from the flask and diluted with 990 milliliters of air. This was then drawn through an Ecolyzer, which has been standardized using a known concentration of carbon monoxide in air.

Table III

| Cigarette | Total Wt. (gm) | Carbon Monoxide (CO) Collection Vol. (L) | * % CO (v/v) | % CO (v/v) per cm. smoked |
|---|---|---|---|---|
| PM-X | 1.2560 | 1 | 2.4 | 0.26 |
| PM-Y | 1.1822 | 1 | 2.1 | 0.22 |
| PM-Z | 1.2456 | 1 | 1.8 | 0.19 |
| L-X | 0.7921 | 1 | 1.0 | 0.13 |
| L-Y | 0.8638 | 1 | 1.4 | 0.18 |
| L-Z | 0.8600 | 1 | 1.5 | 0.19 |

* Percent by volume as carbon monoxide in the collection flask.

The reduction of carbon monoxide is further illustrated by the following average results of the above tests.

| Cigarette | Total Wt. (gm) | Collection Vol. (L) | % CO (v/v) | % CO (v/v) per cm. smoked |
|---|---|---|---|---|
| PM | 1.2279 | 1 | 2.1 | 0.22 |
| L | 0.8386 | 1 | 1.3 | 0.17 |

SUMMARY

The above test results show a dramatic reduction in the harmful agents resulting from cigarette smoking. The reductions are far in excess of that which would be obtained from the expansion of the tobacco indicated by the reduced weight of the cigarettes.

While the preferred embodiment of the present invention has been illustrated by way of example, it is apparent that modifications and adaptations of that embodiment will occur to those skilled in the art. However, it is to be expressly understood that such modifications and adaptations are within the spirit and scope of the present invention as set forth in the following claims.

What we claim as new is:

1. A method for processing tobacco for removing selected agents in said tobacco which are believed to be harmful and for restoring the tobacco to a condition suitable for use in a cigarette, said method comprising the steps of placing the tobacco in a boiling liquid for a preselected time period sufficient to obtain a significant extraction of said tobacco agents; subsequently drying the tobacco to a point at which is friable and generally unsuitable for normal cigarette usage; and subjecting the dried tobacco to an atmosphere generally at ambient temperature and containing water vapor and reducing the temperature of said atmosphere to far less than ambient for a preselected period of time to restore the friable tobacco to a condition suitable for use in a cigarette.

2. A method as recited in claim 1 wherein the temperature of said atmosphere is reduced to a temperature no greater than approximately −50° F.

3. A method as recited in claim 1 wherein the liquid is water.

4. A method as recited in claim 1 wherein the tobacco is placed in the boiling liquid for approximately 15 minutes.

5. A method as recited in claim 1 wherein said atmosphere is defined by a sealed container, the dried tobacco being placed in said sealed container.

6. A method as recited in claim 5 wherein the sealed container containing the tobacco is placed in a dry ice/acetone bath to reduce the temperature of said atmosphere.

7. A method as recited in claim 6 wherein the container is subjected to a temperature no greater than approximately −50° F. for approximately 7 hours.

8. A tobacco product made in accordance with the method of claim 1.

* * * * *